US009938772B2

(12) United States Patent
Richards et al.

(10) Patent No.: US 9,938,772 B2
(45) Date of Patent: Apr. 10, 2018

(54) SYSTEM AND PROCESS FOR DRILLING A PLANNED WELLBORE TRAJECTORY WITH A DOWNHOLE MUD MOTOR

(71) Applicant: Hawg Tools LLC, Denver, CO (US)

(72) Inventors: Daniel J. Richards, Casper, WY (US); Gregory Clarence Goff, Casper, WY (US)

(73) Assignee: Hawg Tools, LLC, Denver, CO (US)

( * ) Notice: Subject to any disclaimer, the term of this patent is extended or adjusted under 35 U.S.C. 154(b) by 137 days.

(21) Appl. No.: 14/870,194

(22) Filed: Sep. 30, 2015

(65) Prior Publication Data

US 2017/0089137 A1 Mar. 30, 2017

(51) Int. Cl.

| | |
|---|---|
| ***E21B 4/02*** | (2006.01) |
| ***E21B 7/06*** | (2006.01) |
| ***E21B 4/00*** | (2006.01) |

(52) U.S. Cl.

CPC ..... *E21B 4/02* (2013.01); *E21B 4/003* (2013.01); *E21B 7/067* (2013.01)

(58) Field of Classification Search

CPC ... E21B 4/02; E21B 7/06; E21B 7/067; E21B 47/01; E21B 47/12

See application file for complete search history.

(56) References Cited

U.S. PATENT DOCUMENTS 6,349,778 B1 2/2002 Blair et al.
9,506,335 B1 * 11/2016 Smith ..... E21B 44/005
2004/0163822 A1 * 8/2004 Zhang ..... E21B 47/122 166/380
2012/0043459 A1 * 2/2012 Hill ..... E21B 23/08 250/269.4
2013/0043076 A1 * 2/2013 Larronde ..... E21B 7/067 175/61
2013/0228381 A1 * 9/2013 Yambao ..... E21B 4/02 175/107
2014/0027175 A1 * 1/2014 Ringer ..... E21B 4/02 175/26
2014/0138157 A1 * 5/2014 Heisig ..... E21B 7/064 175/40

* cited by examiner

*Primary Examiner* — Frederick L Lagman

(74) *Attorney, Agent, or Firm* — James A. Sheridan; Sheridan Law, LLC

(57) ABSTRACT

The disclosure provides a system and process for drilling a subterranean wellbore. An embodiment includes a bottom-hole assembly for a downhole mud motor that incorporates an information sub, such as a measurement-while-drilling or logging-while-drilling tool, at a location below, or down-hole from, the mud motor. The assembly also includes a micronized bit-to-bend length, or a length between a forward end of the assembly's bearing mandrel and a fixed bend in the assembly's housing, of less than or equal to forty inches. The combination of the forward-located information sub and micronized bit-to-bend length allow the driller to rely on real-time data relating to conditions adjacent to the drill bit/bottom of the wellbore and take that real-time drilling data into account in steering the bit along a planned wellbore trajectory. Other embodiments are also disclosed.

20 Claims, 5 Drawing Sheets

SYSTEM AND PROCESS FOR DRILLING A PLANNED WELLBORE TRAJECTORY WITH A DOWNHOLE MUD MOTOR

BACKGROUND

Directional drilling involves the practice of drilling non-vertical wells and is typically employed in oilfield directional drilling, utility installation directional drilling (horizontal directional drilling or directional boring), and surface-in-seam drilling, which horizontally intersects a vertical well target to extract coal bed methane.

Known directional drilling systems generally include a mud motor placed in the drill string to power a bit while drilling. A mud motor is a progressive cavity positive displacement pump that uses drilling fluid from the drill string to create eccentric motion in the power section of the motor (e.g., via turning a helical rotor). This motion is transferred as concentric power through a stator to the drill bit. As a result, the flow of fluid transmits power, allowing the assembly to rotate and turn the bit.

Mud motors can be configured to have a bend in them using different settings on the motor itself. Typical mud motors can be modified from 0 degrees to 4 degrees with several increments in deviation per degree of bend. The amount of bend is determined by a rate of climb or radius of curve needed to reach the target zone. By using a downhole measurement tool such as a measurement-while-drilling (MWD) tool or a logging-while-drilling (LWD) tool, a directional driller can receive and monitor guidance information and/or information regarding rock or sediment characterization in the borehole (e.g., borehole inclination, pressure, and/or gamma radiation counts) and steer the bit to the desired target zone.

Downhole measurement tools such as MWD/LWD tools (hereinafter "information subs") are ordinarily located a considerable distance away from the bit/bore end when the mud motor is in use. Because downhole mud motors are generally not designed or equipped to incorporate information subs at the bit box where the bit attaches to the motor, the sub is often located at a trailing point on the mud motor or along the drill string, placing the information sub anywhere from ten to eighty-five feet above the bit/wellbore end. As a result, guidance and rock characterization information transmitted from the information sub is instructive regarding the location and rock conditions where the bit has previously travelled, not where it currently is. This lack of real-time information has been described as driving a car forward, while looking through the rear window. This information delay becomes problematic in instances where the bit veers of course. Before the driller detects a potential problem, the boring device has veered many feet off of an acceptable trajectory, risking costly and even dangerous mistakes should the bit encounter cable lines, gas lines, unfriendly rock characteristics, or the like.

Even in instances in which it is or could be possible to attach an information sub to the bit box of a downhole mud motor, current bit-to-bend lengths, or the distance between the bit attached to the mud motor and the bend in the mud motor, prevent proper steering. That is, the bit-to-bend lengths of existing downhole mud motors do not allow for modern planned drill trajectories or trajectories that take into account real-time borehole information to be achieved in the vertical, curved, and horizontal sections of the well bore.

As a result of the distant placement of information subs and extended "bit to bends," drillers operate on delayed wellbore location and characterization knowledge and are unable to achieve desired wellbore trajectories or make informed, real-time decisions regarding maintaining and/or correcting wellbore paths.

SUMMARY

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

One embodiment provides a downhole assembly for drilling a planned wellbore trajectory. The assembly includes (1) a power assembly having a rotor activated by fluid transferred from a drill string; (2) a transmission configured to transfer power from the rotor to an output shaft, the output shaft terminating in a bit box having a forward end; (3) a bearing assembly radially and axially supporting the output shaft, where the output shaft is configured to drive a drill bit coupled to the output shaft via the bit box and an information sub, and where the drill bit and the information sub each have forward and rearward ends, the rearward end of the drill bit attaching to the forward end of the information sub and the rearward end of the information sub attaching to the bit box; and (4) a housing structure encompassing the power assembly, the transmission, and the bearing assembly, where the housing structure has a fixed bend located a distance from the forward end of the bit box that is less than or equal to forty inches.

Another embodiment provides a bottom-hole assembly for drilling a planned wellbore trajectory. The assembly includes a downhole mud motor having a housing with a fixed bend encompassing a bearing assembly, a transmission, and a power assembly. The power assembly includes a rotor activated by fluid transferred from a drill string, and the transmission transfers power from the rotor to a bearing mandrel supported by the bearing assembly. The bottom-hole assembly also includes an information sub located below the downhole mud motor, where the information sub is mounted at a forward end of the bearing mandrel. The bottom-hole assembly further includes a bit mounted at a forward end of the information sub. The bit is indirectly driven by the bearing mandrel, where a distance between the forward end of the bearing mandrel and the fixed bend of the housing is less than or equal to forty inches.

Yet another embodiment provides a process for drilling a subterranean wellbore using a bottom-hole assembly for a mud motor. The assembly includes an information sub having forward and rearward ends and a drill bit having a forward end in contact with an end of the wellbore and a rearward end, where the information sub is attached between the rearward end of the bit and a forward end of a bit box of a bearing mandrel driven by the mud motor. The mud motor is encased within a housing having a fixed bend at a distance less than or equal to forty inches from a forward end of the bit box. The process using the bottom-hole assembly includes the steps of (1) receiving, from the information sub, real-time drill data defining wellbore conditions adjacent to the bit; and (2) in response to the real-time drill data, steering the bit along a planned trajectory.

Additional objects, advantages and novel features of the technology will be set forth in part in the description which follows, and in part will become more apparent to those skilled in the art upon examination of the following, or may be learned from practice of the technology.

BRIEF DESCRIPTION OF THE DRAWINGS

Non-limiting and non-exhaustive embodiments of the present invention, including the preferred embodiment, are described with reference to the following figures, wherein like reference numerals refer to like parts throughout the various views unless otherwise specified. Illustrative embodiments of the invention are illustrated in the drawings, in which.

DETAILED DESCRIPTION

Embodiments are described more fully below in sufficient detail to enable those skilled in the art to practice the system and method. However, embodiments may be implemented in many different forms and should not be construed as being limited to the embodiments set forth herein. The following detailed description is, therefore, not to be taken in a limiting sense.

Various embodiments of the systems and processes described herein relate to drilling subterranean wellbores. More specifically, this description discusses an improved bottom-hole assembly for a downhole mud motor and a corresponding process for drilling a planned subterranean trajectory in which a driller may rely on real-time data relating to conditions at the drill bit/bottom of the wellbore and take that real-time drilling data into account in steering the bit along a planned wellbore trajectory.

With reference to FIGS. 1-4, an arrow, F, pointing toward the left denotes a forward drilling direction, understanding that in these figures, the drilling direction is leftward. An arrow, R, pointing toward the right represents a rearward, or up-hole, direction. Parts toward the left, or left-facing portions of parts, are hereinafter referred to as forward or forward facing. Parts toward the right, or right-facing portions of parts, are hereinafter referred to as rearward or rearward facing.

Figure 1:
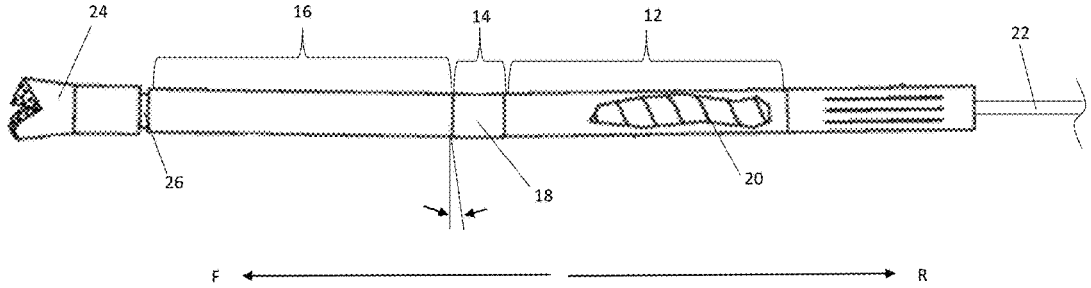
FIG. 1 illustrates a side plan view of an exemplary downhole mud motor.

FIG. 1 illustrates a simple placement schematic for an exemplary downhole mud motor 10 and is included to introduce the various parts of a conventional mud motor. Downhole mud motor 10 includes three major subassemblies—a power assembly 12, a transmission 14, and a bearing assembly 16. Power assembly 12 may include a rotor 20, which is activated by drilling fluid (e.g., water, mud, slurry) transferred from a drill string 22. Rotor 20 acts to convert hydraulic energy from drill string 22 into mechanical rotary power. In this regard, drilling fluid is pumped into power assembly 12 at a pressure that causes rotor 20 to rotate within a stator (not shown). This rotational force is then transmitted through transmission 14, which, in turn, transmits rotational speed and torque generated by power assembly 12 to bearing assembly 16. Bearing assembly 16 may support axial and radial loads during drilling and transmit the rotary drive power from power assembly 12 and transmission 14 to a bit 24 through an output shaft/bearing mandrel 26. A bent housing 18 may encompass these components to facilitate steering along the wellbore path.

Figure 2:
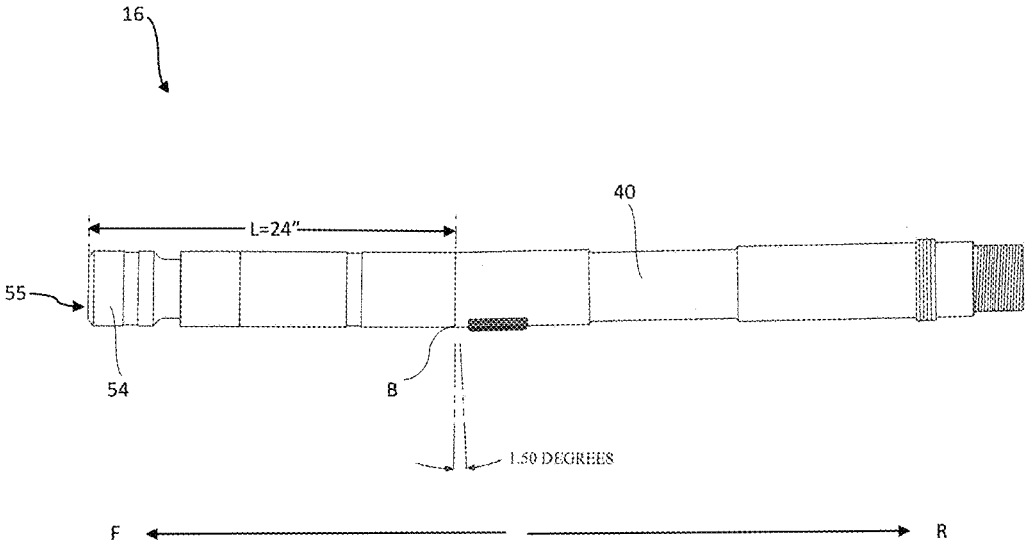
FIG. 2 illustrates a side plan view of one embodiment of a bearing assembly for use with a mud motor of the type shown in FIG. 1.
Figure 3:
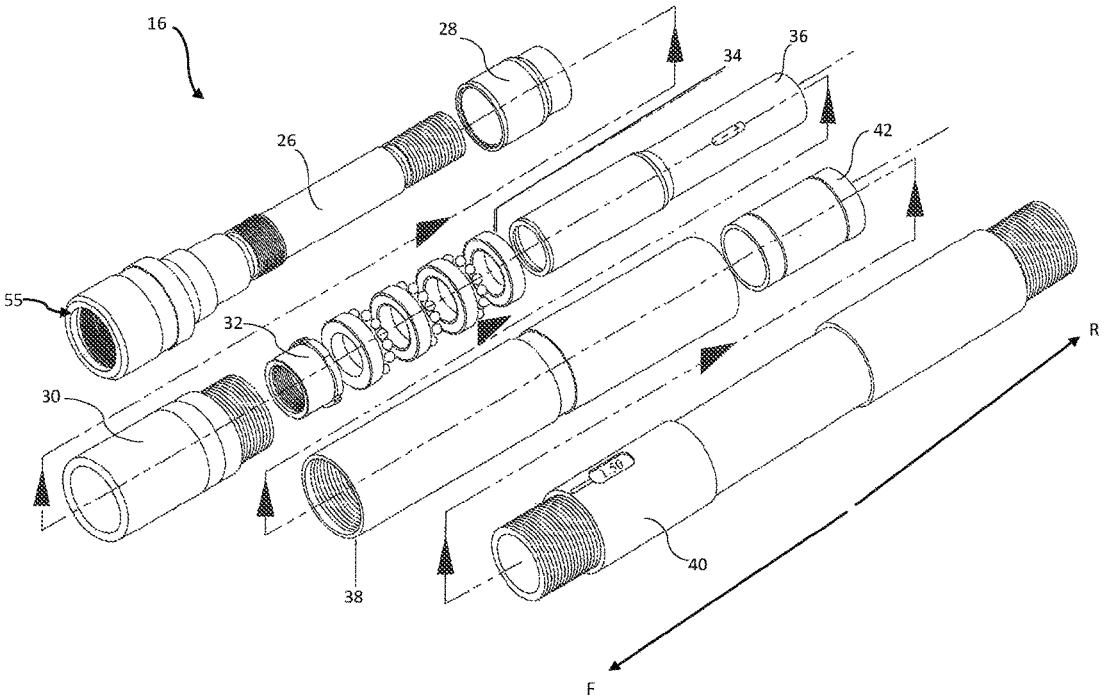
FIG. 3 illustrates an exploded view of the bearing assembly of FIG. 2.

FIG. 2 illustrates a side plan view of one embodiment of an assembled bearing assembly 16 for use with a mud motor of the type described above. FIG. 3 illustrates an exploded view of bearing assembly 16 and details each of its parts. As discussed above, bearing assembly 16 supports axial and radial loads and also transmits the rotary power from transmission 14 (FIG. 1) to drill bit 24 (not shown). In this embodiment, bearing assembly 16 may include output shaft/bearing mandrel 26 (FIG. 3), which is supported by a lower male radial bearing 28, a lower female radial bearing 30, and an anti-fish retainer 32. If bearing mandrel 26 were to separate at a point rearward, or up-hole, from the location of anti-fish retainer 32, anti-fish retainer 32 would allow the remainder of mud motor 10 (FIG. 1) to be easily pulled out of the hole, saving the driller time and money that would have been spent fishing the lower section of the mud motor out of the wellbore. Bearing assembly 16 may also include a thrust bearing assembly 34 and an upper male radial bearing 36. All of these internal components may be nested within an outer bearing housing 38 that links to a fixed bend housing 40 via an upper female radial bearing 42.

Figure 4:
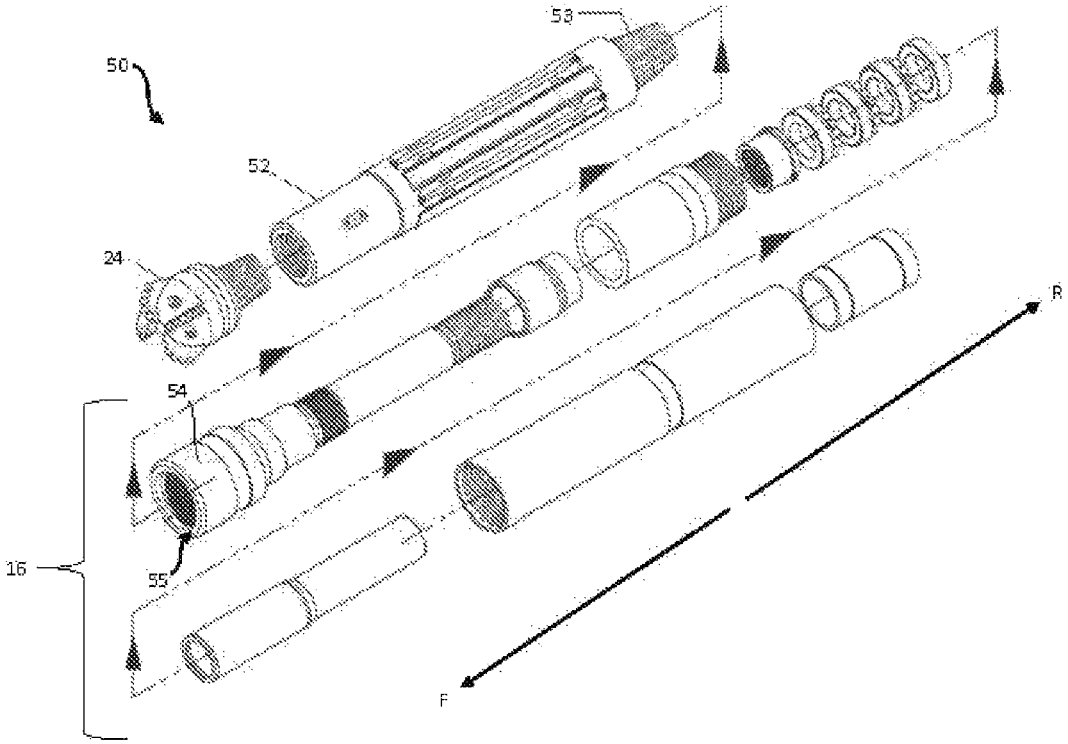
FIG. 4 illustrates an exploded view of a bottom-hole assembly that incorporates the bearing assembly of FIGS. 2-3.

FIG. 4 illustrates an exploded view of one embodiment of a bottom-hole assembly 50 for optional use with a downhole mud motor of the type described in relation to FIG. 1. In this embodiment, bottom-hole assembly 50 may incorporate bearing assembly 16 (FIGS. 2-3) and further include an information sub 52 connected below, or downhole from, bearing assembly 16. As shown in FIG. 4, a rearward end/male coupler 53 of information sub 52 may connect with bearing assembly 16 via a female coupler/bit box 54 incorporated within a forward end 55 of bearing mandrel 26. Female coupler/bit box 54 thereby acts as a receptacle for information sub 52. On its opposite end, or a forward end, information sub 52 may connect with drill bit 24, placing information sub 52 between drill bit 24 and bit box 54.

As discussed above in the Background section, information subs may take a variety of forms and provide numerous types of drill data to the driller. Oftentimes, information subs take the form of measurement-while-drilling or logging-while-drilling tools and include a variety of sensors, a battery, and an antennae having a transmit/receive module (a "TR module") that communicates with above-ground equipment/personnel. Information subs generally provide wellbore location information and/or rock or sediment characterization information. In this regard, drill data may include, by way of a limited sampling, information relating to wellbore inclination, direction, pressure, gamma count, and/or tool face. Transmitting drill data from information sub 52, located below bearing assembly 16 and between bit box 54 and drill bit 24, provides a number of advantages to the driller. Namely, because information sub 52 is located adjacent to drill bit 24, rather than at a rearward location in the bearing assembly or even at a farther rearward location along the mud motor or drill string, drill data is provided to the driller in real time, from a relevant location. The driller receives drill data pertaining to where the bit is currently located, rather than where the bit was located up to eighty-five feet up-hole.

Returning to FIG. 2, in addition to locating information sub 52 below bearing mandrel 26, the dimensions of exemplary bearing assembly 16 may be micronized to produce a predefined distance, L, between forward end/face 55 of female coupler/bit box 54 and a bend, B, of fixed bend housing 40. Bend, B, may form any appropriate and/or desired angle. In many instances, bend, B, is oriented at an angle between one and four degrees. In this embodiment, Bend, B, is oriented at 1.5 degrees. The predefined distance, L, is oftentimes referred to as the "bit to bend" and may be configured to be less than or equal to forty inches, which provides proper geometrical bend placement for improved wellbore trajectories. In this embodiment, the bit-to-bend length, L, is 24 inches, as shown in FIG. 2. To achieve a specific micronized bit-to-bend length, L, the dimensions of each part within bearing assembly 16 (FIGS. 2-3) may be sized accordingly.

The combination of a forward-located information sub 52 and a micronized bit-to-bend length, L, results in numerous practical benefits over existing bottom-hole assemblies for downhole mud motors. First, the driller receives real-time information from a location as close as possible to the wellbore end and can use that information to properly steer drill bit 24, either to maintain a planned subterranean trajectory or to correct the trajectory in response to the real-time drill data. Without the micronized bit-to-bend length, L, existing bottom-hole assemblies have high-angled builds and turn rates that cannot achieve modern trajectories. Even if a driller were to receive real-time, bottom-hole information, the lengthy bit-to-bend length of existing assemblies would not provide for the desired steering capabilities. With the micronized bit-to-bend, the driller can take advantage of real-time drill data to achieve a planned wellbore trajectory in the vertical, curved, and horizontal sections of the wellbore. Because the driller (or engineer or geologist) may operate on real-time drill data that reflects where the bit is, rather than where it has already traveled, subterranean wellbore adjustments made be made as rock/sediment formation and dip changes occur. This limits sidetracks, plug backs, and missed targets. As a result, the improved wellbore knowledge and steering abilities of the micro bit-to-bend reduce the cost and improve the economy of wellbore construction because decisions regarding correcting or maintaining the wellbore path may be more clearly and rapidly made.

The improved bottom-hole assembly 50 is also easier to use and more friendly toward less skilled or less seasoned personnel, and may eliminate the need for specialty services that are currently required to assist in drilling a horizontal/directional wellbore. In this same vein, the more sophisticated and accurate bottom-hole assembly opens opportunities for automation using existing drilling rig equipment, allowing for further cost savings and increased safety resulting from maintaining fewer personnel at the drilling site. Improved bottom-hole assembly 50 also allows for easy assembly on site at the drilling rig and/or in the shop. This time savings translates to lower costs and added safety benefits. Additional savings are achieved because the micronized parts of bearing assembly 16 are smaller and incur lower manufacturing costs due to decreased material usage and manufacturing time.

Overall, bottom-hole assembly 50 allows the drilling system to work and communicate synergistically, from the personnel (e.g., operators, engineers, geologists, rig personnel) to the rig to the assembly itself. Specialty service providers are no longer required to analyze and interpret projected data because the drill data coming from assembly 50 reflects real-time conditions, allowing decisions to be made accurately and in harmonious agreement, without the risks and hassles of predicting, estimating, and guessing that oftentimes invites differing and even fraudulent opinions that skew the drilling process. As a result, the improved bottom-hole assembly 50 with its forward-located information sub and micronized bit-to-bend length adds integrity and accuracy to the whole operation surrounding wellbore drilling.

Figure 5:
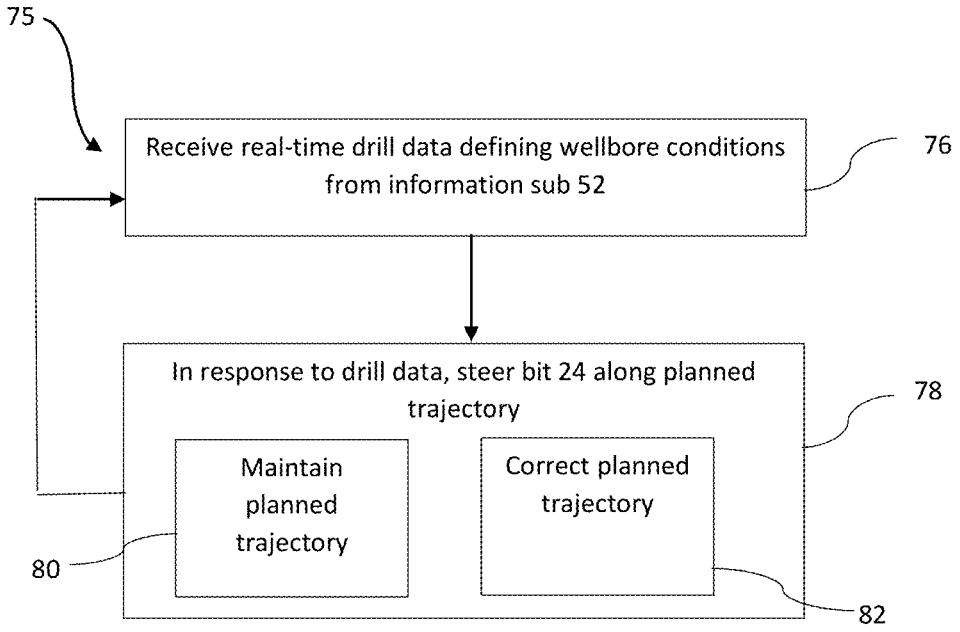
FIG. 5 depicts a flow chart detailing an exemplary process for drilling a planned trajectory with the bottom-hole assembly of FIG. 4 attached to a downhole mud motor.

FIG. 5 depicts a flow chart setting forth an exemplary process 75 for drilling a planned subterranean trajectory. Using a downhole mud motor, such as mud motor 10, outfitted with bottom-hole assembly 50, process 75 beings with receiving (76), from information sub 52, real-time drill data defining wellbore conditions at bit 24. In response to the real-time drill data, process 75 continues with steering (78) bit 24 along a planned trajectory. Such steering (78) may involve maintaining (80) the trajectory or correcting (82) the trajectory to guide bit 24 through the vertical, curved, and/or horizontal sections of the trajectory, all based on the real-time drill data received from information sub 52. Drilling process 75 may be repeated as necessary and/or desired until the trajectory is complete.

Although the above embodiments have been described in language that is specific to certain structures, elements, compositions, and methodological steps, it is to be understood that the technology defined in the appended claims is not necessarily limited to the specific structures, elements, compositions and/or steps described. Rather, the specific aspects and steps are described as forms of implementing the claimed technology. Since many embodiments of the technology can be practiced without departing from the spirit and scope of the invention, the invention resides in the claims hereinafter appended.

What is claimed is:

1. A downhole assembly for drilling a planned wellbore trajectory, comprising:

a power assembly having a rotor activated by fluid transferred from a drill string;

a transmission configured to transfer power from said rotor to an output shaft, said output shaft terminating in a bit box having a forward end;

a bearing assembly radially and axially supporting said output shaft, said output shaft configured to drive a drill bit coupled to said output shaft via said bit box and an information sub, wherein said drill bit and said information sub each have forward and rearward ends, and wherein said rearward end of said drill bit attaches to said forward end of said information sub and said rearward end of said information sub attaches to said bit box; and a housing structure encompassing said power assembly, said transmission, and said bearing assembly, said output shaft rotatably disposed within said housing structure to transfer rotary drive power from said power assembly and said transmission to said bit box, said housing structure having a fixed bend located a distance from said forward end of said bit box, wherein said distance is less than or equal to forty inches, and said output shaft and said fixed bend of said housing structure rotatably isolated from one another.

2. The downhole assembly of claim 1, wherein said fixed bend is a 1.5 degree bend.

3. The downhole assembly of claim 2, wherein said distance from said forward end of said bit box and said fixed bend is twenty-four inches.

4. The downhole assembly of claim 1, wherein said information sub comprises a measurement-while-drilling tool.

5. The downhole assembly of claim 1, wherein said information sub comprises a logging-while-drilling tool.

6. The downhole assembly of claim 1, wherein said information sub provides real-time data relating to drilling conditions adjacent to said rearward end of said bit.

7. The downhole assembly of claim 6, wherein said drilling conditions involve one or more of a wellbore inclination, direction, pressure, gamma count, and tool face.

8. A bottom-hole assembly for drilling a planned wellbore trajectory, comprising:

a downhole mud motor having a housing with a fixed bend encompassing a bearing assembly, a transmission, and a power assembly, wherein said power assembly includes a rotor activated by fluid transferred from a drill string and said transmission transfers power from said rotor to a bearing mandrel supported by said bearing assembly, and said bearing mandrel rotatably disposed within said housing to transfer rotary drive power from said power assembly and said transmission;

an information sub located below said downhole mud motor, said information sub mounted at a forward end of said bearing mandrel; and a bit mounted at a forward end of said information sub, said bit indirectly driven by the rotary drive power from said bearing mandrel, and said bit driven in insolation from rotation of said fixed bend of said housing, wherein a distance between said forward end of said bearing mandrel and said fixed bend of said housing is less than or equal to forty inches.

9. The bottom-hole assembly of claim 8, wherein said forward end of said bearing mandrel forms a female coupler, and wherein said female coupler serves as a receptacle for said information sub.

10. The bottom-hole assembly of claim 8, wherein said information sub comprises a measurement-while-drilling tool or a logging-while-drilling tool.

11. The bottom-hole assembly of claim 8, wherein said fixed bend of said housing comprises an angle between zero and four degrees.

12. The bottom-hole assembly of claim 8, wherein said information sub provides real-time drill data from its location below said downhole mud motor.

13. The bottom-hole assembly of claim 12, wherein said real-time drill data comprises wellbore location information.

14. The bottom-hole assembly of claim 12, wherein said real-time drill data comprises rock formation characterization information.

15. A process for drilling a subterranean wellbore using a bottom-hole assembly for a mud motor, the assembly including an information sub having forward and rearward ends and a drill bit having a forward end in contact with an end of the wellbore and a rearward end, the information sub attached between the rearward end of the bit and a forward end of a bearing mandrel bit box driven by the mud motor, wherein the mud motor is encased within a housing having a fixed bend at a distance less than or equal to forty inches from the forward end of the bit box, the bearing mandrel rotatably disposed within the housing structure to transfer rotary drive power from the mud motor to the forward end, and the bearing mandrel and the fixed bend of the housing rotatably isolated from one another, said process comprising:

receiving, from said information sub, real-time drill data defining wellbore conditions adjacent to the bit; and in response to said real-time drill data, steering the bit along a planned trajectory.

16. The process of claim 15, wherein said planned trajectory includes vertical, curved, and horizontal sections.

17. The process of claim 15, further comprising correcting said planned trajectory in response to said real-time drill data.

18. The process of claim 15, wherein said real-time drill data includes wellbore location information or rock formation characterization information.

19. The process of claim 18, wherein said real-time drill data includes one or more of a wellbore inclination, direction, pressure, gamma count, and tool face.

20. The process of claim 15, wherein said information sub comprises a measurement-while-drilling tool or a logging-while-drilling tool.

* * * * *